US010686253B2

(12) United States Patent
Mohan

(10) Patent No.: US 10,686,253 B2
(45) Date of Patent: Jun. 16, 2020

(54) ANTENNA STRUCTURES FOR SPATIAL POWER-COMBINING DEVICES

(71) Applicant: Qorvo US, Inc., Greensboro, NC (US)

(72) Inventor: Ankush Mohan, Thousand Oaks, CA (US)

(73) Assignee: Qorvo US, Inc., Greensboro, NC (US)

( * ) Notice: Subject to any disclaimer, the term of this patent is extended or adjusted under 35 U.S.C. 154(b) by 50 days.

(21) Appl. No.: 16/008,586

(22) Filed: Jun. 14, 2018

(65) Prior Publication Data

US 2019/0140356 A1 May 9, 2019

Related U.S. Application Data

(60) Provisional application No. 62/548,457, filed on Aug. 22, 2017.

(51) Int. Cl.

| | |
|---|---|
| ***H01Q 13/08*** | (2006.01) |
| ***H01Q 13/02*** | (2006.01) |
| ***H01Q 1/00*** | (2006.01) |
| ***H01Q 15/00*** | (2006.01) |
| ***H01P 5/12*** | (2006.01) |
| ***H01P 5/103*** | (2006.01) |

(52) U.S. Cl.

CPC ..... *H01Q 13/08* (2013.01); *H01P 5/103* (2013.01); *H01P 5/12* (2013.01); *H01Q 1/002* (2013.01); *H01Q 13/0208* (2013.01); *H01Q 15/0053* (2013.01)

(58) Field of Classification Search

CPC ..... H01Q 13/08; H01Q 13/0208; H01Q 15/0053; H01Q 1/002

See application file for complete search history.

(56) References Cited

U.S. PATENT DOCUMENTS 3,023,382 A 2/1962 Borghetti
4,234,854 A 11/1980 Schellenberg et al.

(Continued)

OTHER PUBLICATIONS

Author Unknown, "Interpack 2005: An assessment for PMMI members," 2005, PMMI, 32 pages.

(Continued)

*Primary Examiner* — Hoang V Nguyen

(74) *Attorney, Agent, or Firm* — Withrow & Terranova, P.L.L.C.

(57) ABSTRACT

Spatial power-combining devices, and in particular, antenna structures for spatial power-combining devices are disclosed. A spatial power-combining device includes a plurality of amplifier assemblies, and each amplifier assembly includes an input antenna structure, an amplifier, and an output antenna structure. At least one of the input antenna structure and the output antenna structure may have a profile that includes tuning features, such as steps or other shapes, configured to tune or match with a desired operating frequency range. The tuning features may be configured with one or both of a signal conductor and a ground conductor of at least one of the input and output antenna structures. The tuning features may be non-symmetric across a particular signal conductor or a ground conductor, and the tuning features of a signal conductor may be non-symmetric with the tuning features of a ground conductor.

19 Claims, 11 Drawing Sheets

(56) References Cited

U.S. PATENT DOCUMENTS

| | | | | |
|---|---|---|---|---|
| 4,424,496 | A | 1/1984 | Nichols et al. | |
| 5,036,335 | A | 7/1991 | Jairam | |
| 5,214,394 | A | 5/1993 | Wong | |
| 5,256,988 | A | 10/1993 | Izadian | |
| 5,736,908 | A | 4/1998 | Alexanian et al. | |
| 5,920,240 | A | 7/1999 | Alexanian et al. | |
| 6,028,483 | A | 2/2000 | Shealy et al. | |
| 6,037,840 | A | 3/2000 | Myer | |
| 6,181,221 | B1 | 1/2001 | Kich et al. | |
| 6,828,875 | B2 | 12/2004 | Channabasappa et al. | |
| 7,110,165 | B2 | 9/2006 | Martin et al. | |
| 7,125,220 | B2 * | 10/2006 | Horng | F04D 29/545 415/119 |
| 7,215,220 | B1 | 5/2007 | Jia | |
| 7,466,203 | B2 | 12/2008 | Rector | |
| 8,698,577 | B2 | 4/2014 | Sherrer et al. | |
| 8,928,429 | B2 | 1/2015 | Song et al. | |
| 9,019,036 | B2 | 4/2015 | Kolias et al. | |
| 9,054,427 | B2 | 6/2015 | Guy et al. | |
| 9,065,163 | B1 | 6/2015 | Wu et al. | |
| 9,276,304 | B2 * | 3/2016 | Behan | H01Q 9/28 |
| 9,287,605 | B2 | 3/2016 | Daughenbaugh, Jr. et al. | |
| 9,325,074 | B2 | 4/2016 | Chandler | |
| 9,917,343 | B2 | 3/2018 | Chieh et al. | |
| 9,954,706 | B1 | 4/2018 | Harris et al. | |
| 10,003,118 | B2 | 6/2018 | Kitt | |
| 10,009,067 | B2 | 6/2018 | Birk et al. | |
| 10,164,667 | B1 | 12/2018 | Kitt | |
| 2006/0202777 | A1 * | 9/2006 | Deckman | H03F 3/602 333/125 |
| 2007/0229186 | A1 * | 10/2007 | Hacker | H01P 5/1007 333/125 |
| 2007/0279146 | A1 | 12/2007 | Rector | |
| 2014/0145794 | A1 | 5/2014 | Courtney et al. | |
| 2014/0167880 | A1 | 6/2014 | Daughenbaugh, Jr. et al. | |
| 2017/0149113 | A1 | 5/2017 | Theveneau et al. | |
| 2017/0179598 | A1 | 6/2017 | Kitt | |
| 2018/0294539 | A1 | 10/2018 | Kitt | |
| 2019/0007007 | A1 | 1/2019 | Kitt | |
| 2019/0067778 | A1 | 2/2019 | Mohan | |
| 2019/0067781 | A1 | 2/2019 | Mohan et al. | |
| 2019/0067782 | A1 | 2/2019 | Mohan et al. | |
| 2019/0067783 | A1 | 2/2019 | Mohan et al. | |
| 2019/0067836 | A1 | 2/2019 | Mohan | |
| 2019/0068123 | A1 | 2/2019 | Mohan et al. | |
| 2019/0068140 | A1 | 2/2019 | Mohan et al. | |
| 2019/0068141 | A1 | 2/2019 | Yoon et al. | |

OTHER PUBLICATIONS

Caturla, F., et al., "Electroless Plating of Graphite with Copper and Nickel," Journal of the Electrochemical Soceity, vol. 142, Issue 12, Dec. 1995, The Electrochemical Society, Inc., pp. 4084-4090.

Fitzhugh, William, et al., "Modulation of Ionic Current Limitations by Doping Graphite Anodes," Journal of Electrochemical Society, vol. 165, Issue 10, Jul. 2018, The Electrochemical Society, 6 pages.

Larkins, Grover, et al., "Evidence of Superconductivity in Doped Graphite and Graphene," Superconductor Science and Technology, vol. 29, Issue 1, Dec. 2015, IOP Publishing Ltd, 18 pages.

Glenis, S., et al., "Sulfur doped graphite prepared via arc discharge of carbon rods in the presence of thiopenes," Journal of Applied Physics, vol. 86, Issue 8, Oct. 1999, American Institute of Physics, pp. 4464-4466.

Scheike, T., et al., "Can doping graphite trigger room temperature superconductivity: Evidence for granular high-temperature superconductivity in water-treated graphite powder," Advanced Materials, vol. 24, Issue 43, Sep. 2012, 19 pages.

Smalc, Martin, et al., "Thermal Performance of Natural Graphite Heat Spreaders," Proceedings of IPACK2005, Jul. 17-22, San Francisco, California, American Society of Mechanical Engineers, 11 pages.

Notice of Allowance for U.S. Appl. No. 15/637,472, dated Mar. 12, 2019, 7 pages.

Non-Final Office Action for U.S. Appl. No. 15/846,840, dated Mar. 21, 2019, 4 pages.

Non-Final Office Action for U.S. Appl. No. 15/933,783, dated May 1, 2019, 8 pages.

Non-Final Office Action for U.S. Appl. No. 16/042,351, dated Jul. 5, 2019, 5 pages.

Notice of Allowance for U.S. Appl. No. 15/846,840, dated Jul. 5, 2019, 7 pages.

Non-Final Office Action for U.S. Appl. No. 15/981,535, dated Jul. 8, 2019, 5 pages.

Non-Final Office Action for U.S. Appl. No. 15/637,472, dated Aug. 10, 2018, 8 pages.

Notice of Allowance for U.S. Appl. No. 15/927,565, dated Aug. 8, 2018, 8 pages.

Non-Final Office Action for U.S. Appl. No. 15/933,821, dated Jul. 11, 2019, 7 pages.

Non-Final Office Action for U.S. Appl. No. 15/981,516, dated Jul. 17, 2019, 5 pages.

Notice of Allowance for U.S. Appl. No. 15/845,225, dated Jan. 10, 2019, 7 pages.

Notice of Allowance for U.S. Appl. No. 16/166,548, dated Nov. 29, 2018, 8 pages.

Author Unknown, "Spatial Combining Technology: Revolutionizing the Microwave Power Amplifier," Microwave Journal, Sep. 8, 2008, http://www.microwavejournal.com/articles/print/6838-spatial-combining, CAP Wireless Inc., 7 pages.

Author Unknown, "Vivaldi antenna," Wikipedia, web page last edited Feb. 7, 2017, accessed May 11, 2017, https://en.wikipedia.org/wiki/Vivaldi_antenna, Wikimedia Foundation, Inc., 2 pages.

Courtney, Patrick G. et al., "120 W Ka Band Power Amplifier Utilizing GaN MMICs and Coaxial Waveguide Spatial Power Combining," White Paper, May 2016, Qorvo, pp. 1-8.

Jia, Pengcheng et al., "Broadband High Power Amplifier using Spatial Power Combining Technique" IEEE Transactions on Microwave Theory and Techniques, vol. 51, Issue 12, Dec. 2003, IEEE, 4 pages.

Leggieri, Alberto et al., "The Squarax Spatial Power Combiner," Progress in Electromagnetics Research C, vol. 45, Oct. 2013, EMW Publishing, pp. 43-55.

Ortiz, Sean C., "High Power Spatial Combiners: Tile and Tray Approaches," Dissertation, North Carolina State University, Electrical Engineering, Nov. 2001, 194 pages.

Notice of Allowance for U.S. Appl. No. 15/290,749, dated Feb. 16, 2018, 9 pages.

Amjadi, S., et al., "Design of a Broadband Eight-Way Coaxial Wavelength Power Combiner," IEEE Transactions on Microwave Theory and Techniques, vol. 60, Issue 1, Nov. 15, 2011, pp. 39-45.

Beyers, R., et al., "Compact Conical-Line Power Combiner Design Using Circuit Models," IEEE Transactions on Microwave Theory and Techniques, vol. 62, Issue 11, Oct. 9, 2014, pp. 2650-2658.

Fathy, A., et al., "A Simplified Approach for Radial Power Combiners," IEEE Transactions on Microwave Theory and Techniques, vol. 54, No. 1, Jan. 2006, pp. 247-255.

Gharehkand, F., "Design of a 16 Way Radial Microwave Power Divider/Combiner with Rectangular Waveguide Output and Coaxial Inputs," International Journal of Electronics and Communications (AEU), vol. 68, 2014, pp. 422-428.

Tribak, A., et al., "Ultra-Broadband High Efficiency Mode Converter," Progress in Electromagnetics Research C, vol. 36, 2013, pp. 145-158.

Montgomery, R., et al., "Solid-State PAs Bathe TWTAs for ECM Systems," Microwave Journal, Jun. 2017 Supplement, Jun. 14, 2017, 3 pages.

Möttönen, V. S., "Receiver Front-End Circuits and Components for Millimetre and Submillimetre Wavelengths," Dissertation for the degree of Doctor of Science in Technology, Helsinki University of Technology, Department of Electrical and Communications Engineering, Radio Laboratory, Apr. 2005, 40 pages.

Non-Final Office Action for U.S. Appl. No. 16/005,794, dated Oct. 7, 2019, 11 pages.

(56) References Cited

OTHER PUBLICATIONS

Notice of Allowance for U.S. Appl. No. 16/042,351, dated Nov. 18, 2019, 7 pages.
Corrected Notice of Allowance and Examiner-Initiated Interview Summary for U.S. Appl. No. 15/846,840, dated Dec. 12, 2019, 6 pages.
Non-Final Office Action for U.S. Appl. No. 16/191,541, dated Dec. 9, 2019, 7 pages.
Notice of Allowance for U.S. Appl. No. 16/005,794, dated Jan. 9, 2020, 7 pages.
Non-Final Office Action for U.S. Appl. No. 16/032,252, dated Dec. 27, 2019, 5 pages.
Corrected Notice of Allowance and Applicant-Initiated Interview Summary for U.S. Appl. No. 15/846,840, dated Dec. 31, 2019, 6 pages.
Notice of Allowance for U.S. Appl. No. 15/981,535, dated Dec. 31, 2019, 7 pages.
Notice of Allowance for U.S. Appl. No. 15/933,821, dated Jan. 15, 2020, 7 pages.
Non-Final Office Action for U.S. Appl. No. 16/039,435, dated Jan. 7, 2020, 5 pages.
Notice of Allowance for U.S. Appl. No. 15/981,516, dated Jan. 15, 2020, 7 pages.
Final Office Action for U.S. Appl. No. 16/191,541, dated Mar. 31, 2020, 8 pages.

* cited by examiner

ANTENNA STRUCTURES FOR SPATIAL POWER-COMBINING DEVICES

RELATED APPLICATION

This application claims the benefit of provisional patent application Ser. No. 62/548,457, filed Aug. 22, 2017, the disclosure of which is hereby incorporated herein by reference in its entirety.

FIELD OF THE DISCLOSURE

The disclosure relates generally to spatial power-combining devices and, more particularly, to antenna structures for spatial power-combining devices.

BACKGROUND

Spatial power-combining devices, such as a Qorvo® Spatium® spatial power-combining device, are used for broadband radio frequency power amplification in commercial and defense communications, radar, electronic warfare, satellite, and various other communication systems. Spatial power-combining techniques are implemented by combining broadband signals from a number of amplifiers to provide output powers with high efficiencies and operating frequencies. One example of a spatial power-combining device utilizes a plurality of solid-state amplifier assemblies that form a coaxial waveguide to amplify an electromagnetic signal. Each amplifier assembly may include an input antenna structure, an amplifier, and an output antenna structure. When the amplifier assemblies are combined to form the coaxial waveguide, the input antenna structures may form an input antipodal antenna array, and the output antenna structures may form an output antipodal antenna array.

In operation, an electromagnetic signal is passed through an input port to an input coaxial waveguide section of the spatial power-combining device. The input coaxial waveguide section distributes the electromagnetic signal to be split across the input antipodal antenna array. The amplifiers receive the split signals and in turn transmit amplified split signals across the output antipodal antenna array. The output antipodal antenna array and an output coaxial waveguide section combine the amplified split signals to form an amplified electromagnetic signal that is passed to an output port of the spatial power-combining device.

Antenna structures for spatial power-combining devices typically include an antenna signal conductor and an antenna ground conductor deposited on opposite sides of a substrate, such as a printed circuit board. The size of the antenna structures are related to an operating frequency of the spatial power-combining device. For example, the size of the input antenna structure is related to the frequency of energy that can be efficiently received, and the size of the output antenna structure is related to the frequency of energy that can be efficiently transmitted. If the size of either the input antenna structure or the output antenna structure is not matched to a desired operating frequency range, then reception or transmission may be impaired.

SUMMARY

Aspects disclosed herein include spatial power-combining devices, and in particular, antenna structures for spatial power-combining devices. A spatial power-combining device includes a plurality of amplifier assemblies, and each amplifier assembly includes an input antenna structure, an amplifier, and an output antenna structure. At least one of the input antenna structure and the output antenna structure may have a profile that includes tuning features, such as steps or other shapes, configured to tune or match with a desired operating frequency range. The tuning features may be configured with one or both of a signal conductor and a ground conductor of at least one of the input and output antenna structures. The tuning features may be non-symmetric across a particular signal conductor or a ground conductor, and the tuning features of a signal conductor may be non-symmetric with the tuning features of a ground conductor.

In some aspects, a spatial power-combining device for modifying a signal comprises a plurality of amplifier assemblies, wherein each amplifier assembly of the plurality of amplifier assemblies comprises an amplifier; an input antenna structure comprising an input signal conductor and an input ground conductor; an output antenna structure comprising an output signal conductor and an output ground conductor, wherein at least one of the input signal conductor, the input ground conductor, the output signal conductor, and the output ground conductor comprises a stepped profile. In some embodiments, the stepped profile comprises a series of steps in a first direction and the series of steps includes at least a first step that is non-symmetric with a second step. The first step may increase a height of the stepped profile and the second step may decrease a height of the stepped profile. The first step may also include a different height or length than the second step.

In some embodiments, the input antenna structure further comprises a substrate comprising a first face and a second face that opposes the first face and wherein the input signal conductor is on the first face and the input ground conductor is on the second face. In other embodiments the input signal conductor and the input ground conductor are separated by air.

In some embodiments, the spatial power-combining device further comprises an input coaxial waveguide section configured to concurrently provide a signal to the input antenna structure of each amplifier assembly of the plurality of amplifier assemblies; and an output coaxial waveguide section configured to concurrently combine a signal from the output antenna structure of each amplifier assembly of the plurality of amplifier assemblies.

In some embodiments, at least one of the input signal conductor and the output signal conductor comprises a filter element. The filter element comprises at least one of a low-pass filter, a high-pass filter, a band-pass filter, and a band-stop filter.

In some aspects, a spatial power-combining device for modifying a signal comprises a plurality of amplifier assemblies, wherein each amplifier assembly of the plurality of amplifier assemblies comprises an amplifier; and an antenna structure comprising a signal conductor with a first stepped profile and a ground conductor with a second stepped profile; wherein the first stepped profile and the second stepped profile diverge from one another in a first direction. In some embodiments, the first stepped profile is non-symmetric with the second stepped profile. The signal conductor may comprise a first step and the ground conductor may comprise a second step that is registered with the first step along the first direction. The first step may extend toward the ground conductor and the second step may extend away from the signal conductor. The first step may also include a different height or length than the second step.

In some embodiments, the antenna structure further comprises a substrate comprising a first face and a second face that opposes the first face and wherein the signal conductor is on the first face and the ground conductor is on the second face. In other embodiments the signal conductor and the ground conductor are separated by air.

In some embodiments, the spatial power-combining device further comprises a coaxial waveguide section configured to concurrently provide a signal to the antenna structure of each amplifier assembly of the plurality of amplifier assemblies.

In some embodiments, the spatial power-combining device further comprises a filter element that includes at least one of a low-pass filter, a high-pass filter, a band-pass filter, and a band-stop filter.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
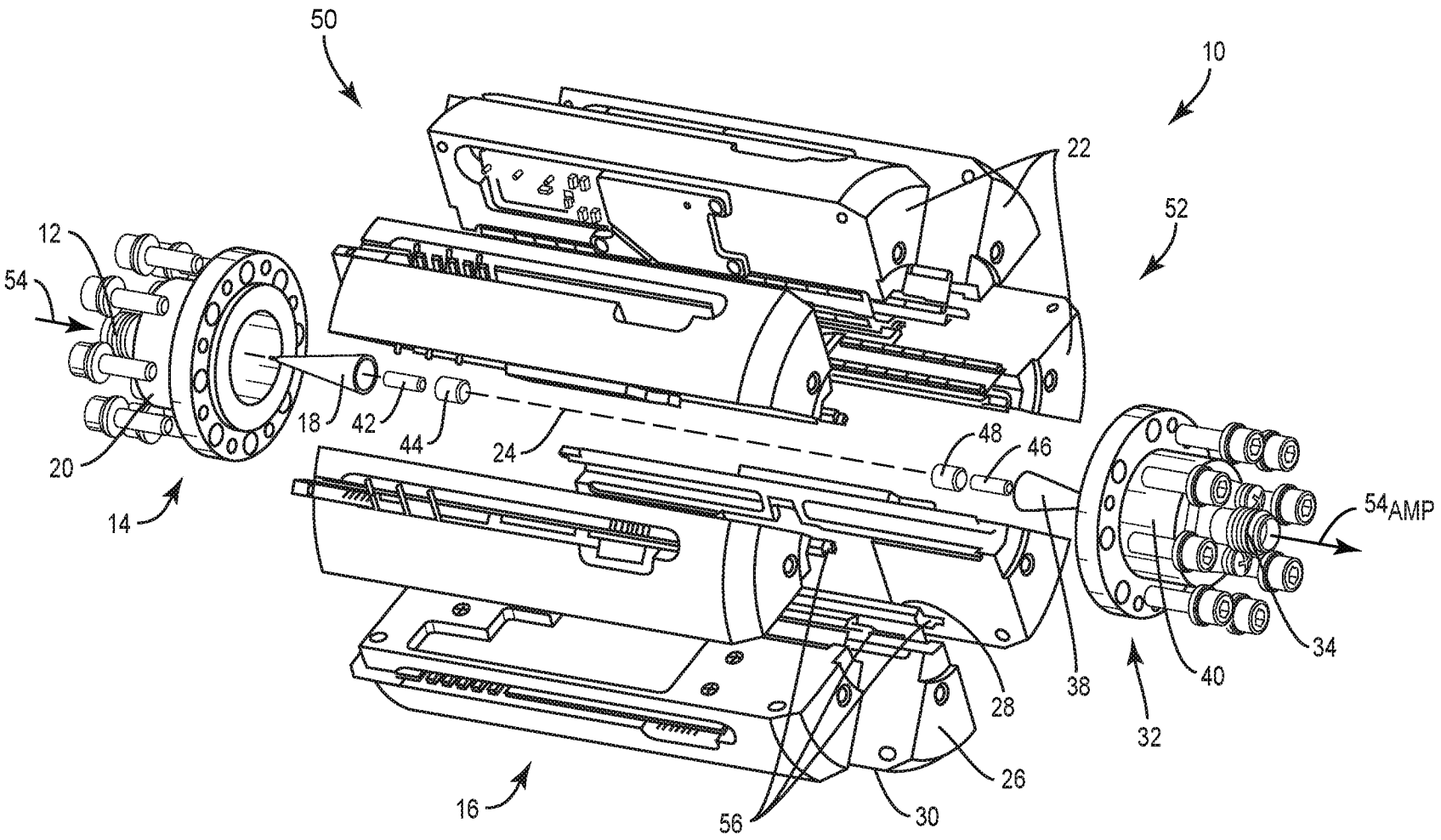
FIG. 1 is a perspective exploded view of a representative spatial power-combining device according to some embodiments.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Aspects disclosed herein include spatial power-combining devices, and in particular, antenna structures for spatial power-combining devices. A spatial power-combining device includes a plurality of amplifier assemblies, and each amplifier assembly includes an input antenna structure, an amplifier, and an output antenna structure. At least one of the input antenna structure and the output antenna structure may have a profile that includes tuning features, such as steps or other shapes, configured to tune or match with a desired operating frequency range. The tuning features may be configured with one or both of a signal conductor and a ground conductor of at least one of the input and output antenna structures. The tuning features may be non-symmetric across a particular signal conductor or a ground conductor, and the tuning features of a signal conductor may be non-symmetric with the tuning features of a ground conductor.

The embodiments are particularly adapted to spatial power-combining devices that operate at microwave frequencies such as, by way of non-limiting example, energy between about 300 megahertz (MHz) (100 centimeters (cm) wavelength) and 300 gigahertz (GHz) (0.1 cm wavelength). Additionally, embodiments may comprise operating frequency ranges that extend above microwave frequencies. A spatial power-combining device may operate within one or more common radar bands including, but not limited to S-band, C-band, X-band, Ku-band, K-band, Ka-band, and Q-band. In some embodiments, by way of non-limiting examples, the operating frequency range includes an operating bandwidth spread of 2 GHz to 20 GHz. In other embodiments, the operating frequency range includes an operating bandwidth spread of 4 GHz to 41 GHz.

A spatial power-combining device generally includes a plurality of amplifier assemblies, and each amplifier assembly is an individual signal path and includes an amplifier connected to an input antenna structure and an output antenna structure. An input coaxial waveguide is configured to provide a signal concurrently to each input antenna structure, and an output coaxial waveguide is configured to concurrently combine amplified signals from each output antenna structure. The plurality of amplifier assemblies are arranged coaxially about a center axis. Accordingly, the spatial power-combining device is configured to split, amplify, and combine an electromagnetic signal.

FIG. 1 is a perspective exploded view of a representative spatial power-combining device 10 according to some embodiments. The spatial power-combining device 10 comprises an input port 12 and an input coaxial waveguide section 14. The input coaxial waveguide section 14 provides a broadband transition from the input port 12 to a center waveguide section 16. Electrically, the input coaxial waveguide section 14 provides broadband impedance matching from an impedance $Z_{p1}$ of the input port 12 to an impedance $Z_c$ of the center waveguide section 16. The input coaxial waveguide section 14 comprises an input inner conductor 18 and an input outer conductor 20. Outer surfaces of the input inner conductor 18 and inner surfaces of the input outer conductor 20 have gradually changed profiles configured to minimize the impedance mismatch from the input port 12 to the center waveguide section 16.

The center waveguide section 16 comprises a plurality of amplifier assemblies 22 arranged radially around a center axis 24 of the spatial power-combining device 10. Each amplifier assembly 22 comprises a body 26 having a predetermined wedge-shaped cross-section, an inner surface 28, and an arcuate outer surface 30. When the amplifier assemblies 22 are collectively assembled, they may form a cylinder with a cylindrical central cavity, defined by the inner surfaces 28.

The spatial power-combining device 10 also comprises an output coaxial waveguide section 32 and an output port 34. The input port 12 and the output port 34 may comprise field-replaceable Subminiature A (SMA) connectors. In other embodiments, the input port 12 or the output port 34 may comprise at least one of a super SMA connector, a type N connector, a type K connector, a WR28 connector, other coaxial to waveguide transition connectors, or any other suitable coaxial or waveguide connectors. The output coaxial waveguide section 32 provides a broadband transition from the center waveguide section 16 to the output port 34. Electrically, the output coaxial waveguide section 32 provides broadband impedance matching from the impedance $Z_c$ of the center waveguide section 16 to an impedance $Z_{p2}$ of the output port 34. The output coaxial waveguide section 32 comprises an output inner conductor 38 and an output outer conductor 40. Outer surfaces of the output inner conductor 38 and inner surfaces of the output outer conductor 40 have gradually changed profiles configured to minimize the impedance mismatch from the output port 34 to the center waveguide section 16. In some embodiments, impedance matching is configured for 50 Ohms, although other designs such as 30 Ohms are possible. A first screw 42 and a first nut 44 are provided for mechanically attaching the input inner conductor 18 to the plurality of amplifier assemblies 22. In a similar manner, a second screw 46 and a second nut 48 are provided for mechanically attaching the output inner conductor 38 to the plurality of amplifier assemblies 22. The plurality of amplifier assemblies 22 comprise an input end 50 and an output end 52. The input inner conductor 18 is mechanically attached to the input end 50, and the output inner conductor 38 is mechanically attached to the output end 52. Accordingly, a spatial power-combining device 10 is provided that comprises a center waveguide section 16 comprising a plurality of amplifier assemblies 22, wherein the plurality of amplifier assemblies 22 forms an input end 50 and an output end 52, an input inner conductor 18 mechanically attached to the input end 50, and an output inner conductor 38 mechanically attached to the output end 52. In some embodiments, the input inner conductor 18 may be directly attached to the input end 50 and the output inner conductor 38 may be directly attached to the output end 52.

In other embodiments of spatial power-combining devices, inner conductors may be mechanically attached to a separate support element, such as a center post or rod. Amplifier assemblies may be stacked circumferentially around the center post and may have inner surfaces that conform to the outer shape of the center post. Accordingly, the center post is provided for mechanical support and assembly of the spatial power-combining device. As previously described, mechanical support in the spatial power-combining device 10 of FIG. 1 comprises mechanically attaching the input inner conductor 18 to the input end 50 of the plurality of amplifier assemblies 22 and mechanically attaching the output inner conductor 38 to the output end 52 of the plurality of amplifier assemblies 22. A separate support element, such as a center post or rod, is therefore not required for assembly. Removing the center post may have particular benefit for applications that include higher frequency operation with shorter wavelengths of electromagnetic radiation and increased bandwidth. For these applications, it may be preferable for the spatial power-combining device 10 to have smaller dimensions. Accordingly, spacing of the amplifier assemblies 22 relative to each other may be reduced around the center axis 24 without a center post present. In some applications, the operating frequency range includes an operating bandwidth spread of 4 GHz to 41 GHz. In other embodiments, such as those with an operating frequency range of 2 GHz to 20 GHz, a center post or rod may be present.

In operation, the input port 12 receives a signal 54, and the input coaxial waveguide section 14 is configured to provide the signal 54 concurrently to each of the amplifier assemblies 22 where the signal 54 is concurrently amplified by the respective amplifier assemblies 22. The output coaxial waveguide section 32 is configured to concurrently combine the amplified signals to form an amplified output signal $\mathbf{54}_{AMP}$, which is propagated through the output coaxial waveguide section 32 to the output port 34 for transmitting the amplified output signal $\mathbf{54}_{AMP}$.

According to some embodiments, the amplifier assemblies 22 each comprise an output connector portion 56 configured to mechanically attach to the output inner conductor 38. The output connector portions 56 comprise a shape, such as curved in FIG. 1, that when assembled, are configured to collectively attach with the output inner conductor 38. In a similar manner, the amplifier assemblies 22 may each comprise an input connector portion (not shown) configured to mechanically attach to the input inner conductor 18.

Figure 2:
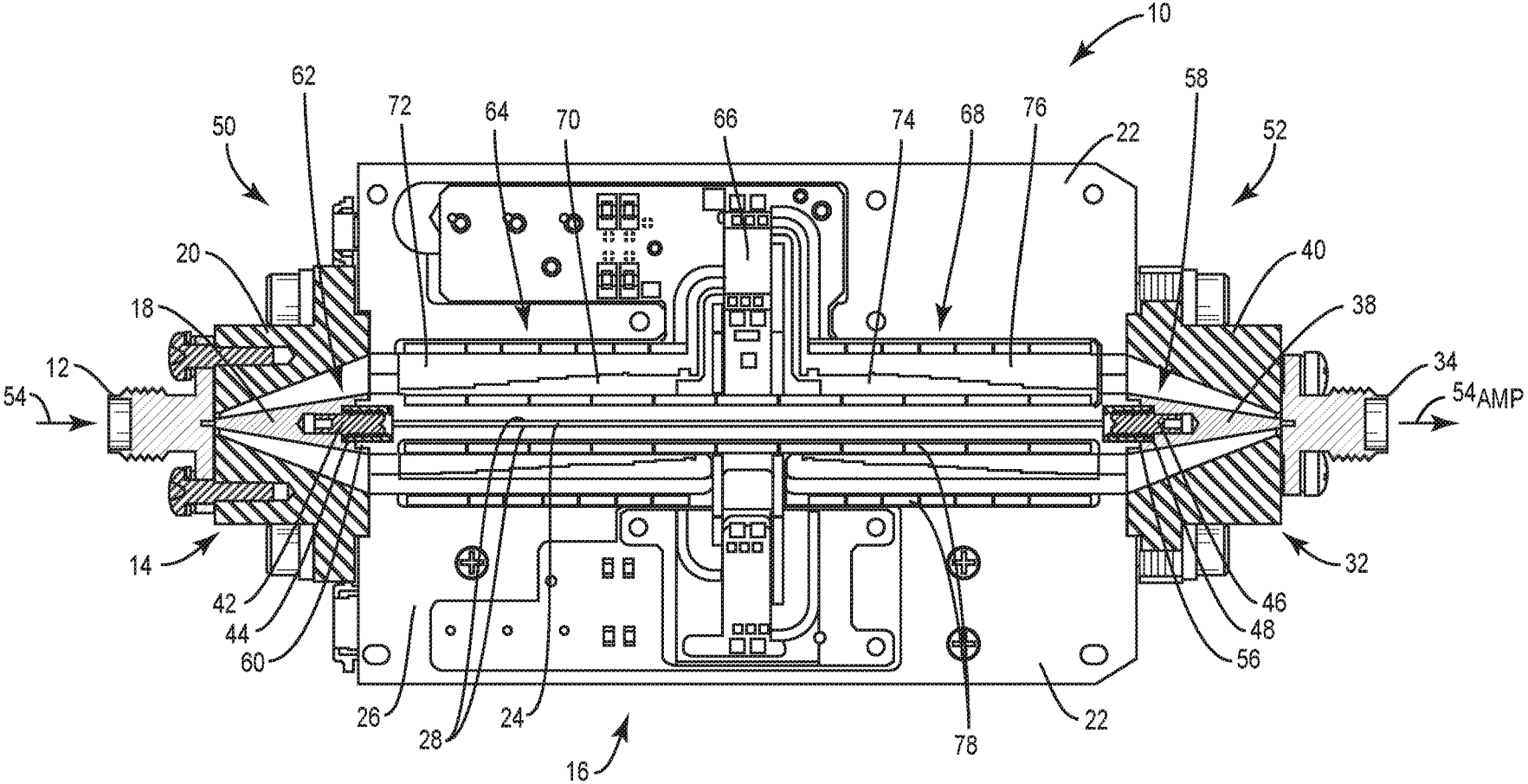
FIG. 2 is a partial and unexploded cross-sectional view of the spatial power-combining device of FIG. 1.

FIG. 2 is a partial and unexploded cross-sectional view of the spatial power-combining device 10 of FIG. 1. Several amplifier assemblies 22 are omitted to illustrate the following details. Both the input end 50 and the output end 52 of the plurality of amplifier assemblies 22 are visible within the center waveguide section 16. The input port 12 and the input coaxial waveguide section 14 are located adjacent the input end 50, and the output port 34 and the output coaxial waveguide section 32 are located adjacent the output end 52. The input coaxial waveguide section 14 comprises the input inner conductor 18 and the input outer conductor 20, and the output coaxial waveguide section 32 comprises the output inner conductor 38 and the output outer conductor 40. The output connector portions 56 of the plurality of amplifier assemblies 22 collectively form an output connector receptacle 58, and input connector portions 60 of the plurality of amplifier assemblies 22 collectively form an input connector receptacle 62. In some embodiments, the output connector receptacle 58 and the input connector receptacle 62 comprise a cylindrical shape, although other shapes are possible, including various polygonal shapes.

As shown, the input inner conductor 18 is configured to mechanically attach to the input end 50 at the input connector receptacle 62 by the first screw 42, and the output inner conductor 38 is configured to mechanically attach to the output end 52 at the output connector receptacle 58 by the second screw 46. The first nut 44 is inside the input connector receptacle 62 and is configured to receive the first screw 42, and the second nut 48 is inside the output connector receptacle 58 and is configured to receive the second screw 46. The mechanical attachment of the input inner conductor 18 and the output inner conductor 38 to the input end 50 and output end 52, respectively, allows the center axis 24 to be hollow, and thus the inner surface 28 of the body 26 of each amplifier assembly 22 is separated from the center axis 24 by empty space. For example, the inner surface 28 of each amplifier assembly 22 is separated from the center axis 24 completely by empty space, with no support structure in between. In some embodiments, the inner surface 28 of each amplifier assembly 22 is spaced from the center axis 24 by a distance of no more than 50 mil, and in further embodiments the spacing may be smaller. For example, the inner surface 28 of each amplifier assembly 22 may be spaced from the center axis 24 by a distance of about 10 mil. Amplifier assemblies in conventional spatial power-combining devices are not spaced from a center axis by a distance of 50 mil or less due to the presence of the center rod. For example, conventional spatial power-combining devices with center rods typically have amplifier assemblies spaced from the center axis by at least 80 mil.

Accordingly, the spacing of the amplifier assemblies can be reduced to achieve higher frequency operation and increased bandwidth. In some applications, the operating frequency range includes an operating bandwidth spread of 4 GHz to 41 GHz. For such applications, the reduced spacing may only allow for a reduced number of amplifier assemblies. In some embodiments, the plurality of amplifier assemblies comprise fewer than ten amplifier assemblies. For the operating bandwidth spread of 4 GHz to 41 GHz, some embodiments may comprise eight amplifier assemblies and may therefore be referred to as an eight-way spatial power-combining device, as represented in FIG. 1. In other embodiments with a lower operating bandwidth spread, such as 2 GHz to 20 GHz, the spacing may be greater and more amplifier assemblies may be included.

As shown in FIG. 2, each amplifier assembly 22 comprises an input antenna structure 64, an amplifier 66, and an output antenna structure 68. In some embodiments, the amplifier 66 comprises a monolithic microwave integrated circuit (MMIC) amplifier. The MMIC may be a solid-state gallium nitride (GaN)-based MMIC. A GaN MMIC device provides high power density and bandwidth, and a spatial power-combining device may combine power from a plurality of GaN MMICs efficiently in a single step to minimize combining loss. The input antenna structure 64 comprises an input antenna pattern, with an input signal conductor 70 visible in FIG. 2, supported on a first board 72. The output antenna structure 68 comprises an output antenna pattern, with an output signal conductor 74 visible in FIG. 2, supported on a second board 76. It is understood that the input antenna pattern may additionally include an input ground conductor on an opposite side of the first board 72, and the output antenna pattern may additionally comprise an output ground conductor on an opposite side of the second board 76. The first board 72 and the second board 76 may comprise substrates, such as printed circuit boards, that provide the desired form factor and mechanical support for the input antenna pattern and the output antenna pattern, respectively. Additionally, one or more electromagnetic interference filters 78 are supported on both the first board 72 and the second board 76. The electromagnetic interference filters 78 are located around the input antenna pattern and the output antenna pattern to help suppress modes and reduce leakage between the amplifier assemblies 22.

In operation, the signal 54 enters through the input port 12 and propagates through the input coaxial waveguide 14 to the input antenna structure 64 of each amplifier assembly 22. Each input antenna structure 64 couples the signal 54 to each amplifier 66, and each output antenna structure 68 couples the amplified signal $\mathbf{54}_{AMP}$ to the output coaxial waveguide section 32 to be propagated to the output port 34.

Figure 3:
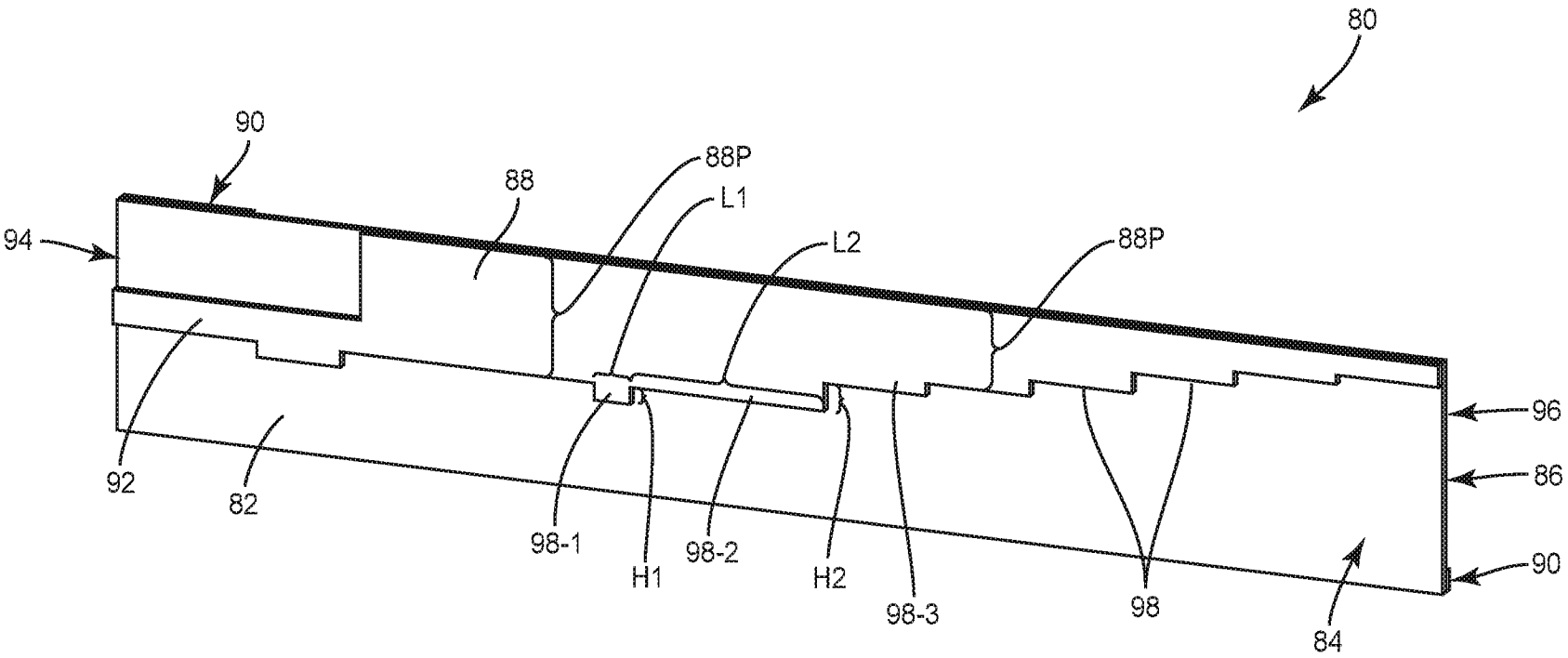
FIG. 3 is a perspective view of a representative antenna structure according to some embodiments.

FIG. 3 is a perspective view of a representative antenna structure 80 according to some embodiments. The antenna structure 80 may represent an input antenna structure or an output antenna structure as previously described. The antenna structure 80 includes a board 82, or substrate, that has a first face 84 and a second face 86 that opposes the first face 84. The first face 84 supports a signal conductor 88 and the second face 86 supports a ground conductor 90 that is barely visible in the perspective view of FIG. 3. The board 82 may be a printed circuit board and provides a desired form factor and mechanical support for the signal conductor 88 and the ground conductor 90. The signal conductor 88 includes a signal connector portion 92 adjacent a first edge 94 of the antenna structure 80 that is configured to be coupled to an amplifier in a spatial power-combining device. In operation, the antenna structure 80 may be configured as an input antenna structure or an output antenna structure to deliver or transmit a portion of an electromagnetic signal to or from an amplifier via the signal connector portion 92. The signal conductor 88 includes a first profile 88P that tapers from the first edge 94 toward a second edge 96 that opposes the first edge 94. For reference, FIG. 3 includes two brackets for the first profile 88P to indicate the tapering from left to right in the figure. Rather than have a continuous taper, the signal conductor 88 includes first tuning features 98 configured to provide a desired operating frequency and an operating bandwidth. Each of the first tuning features 98 is configured for a different portion of the operating bandwidth. In some embodiments, the first tuning features 98 form the first profile 88P that is stepped. In this manner, the first tuning features 98 include a series of steps 98-1 to 98-3 in a first direction from the first edge 94 to the second edge 96. The series of steps 98-1 to 98-3 include at least a first step 98-1 that is non-symmetric with a second step 98-2. In further embodiments, each of the series of steps 98-1 to 98-3 are non-symmetric with each other. Non-symmetric steps may include steps having different shapes. For example, the first step 98-1 may increase a height of the first profile 88P and the second step 98-2 may decrease a height of the first profile 88P, where profile height is measured as a total distance of the signal conductor 88 in a direction parallel to the first edge 94 and the second edge 96. Additionally, non-symmetric steps may include steps of differing lengths and steps of differing heights. For example, in some embodiments, the first step 98-1 comprises a different height than the second step 98-2, where step height is the distance from the first step 98-1 to the second step 98-2 as measured in a direction parallel to the first edge 94 and the second edge 96. By way of example, in FIG. 3, the first step 98-1 has a height H1 that is smaller than a height H2 of the second step 98-2. In some embodiments, the first step 98-1 comprises a different length than the second step 98-2, where step length is measured lengthwise across the antenna structure 80 in a direction perpendicular to the first edge 94 and the second edge 96. By way of example, in FIG. 3, the first step 98-1 has a length L1 that is smaller than a length L2 of the second step 98-2.

Figure 4A:
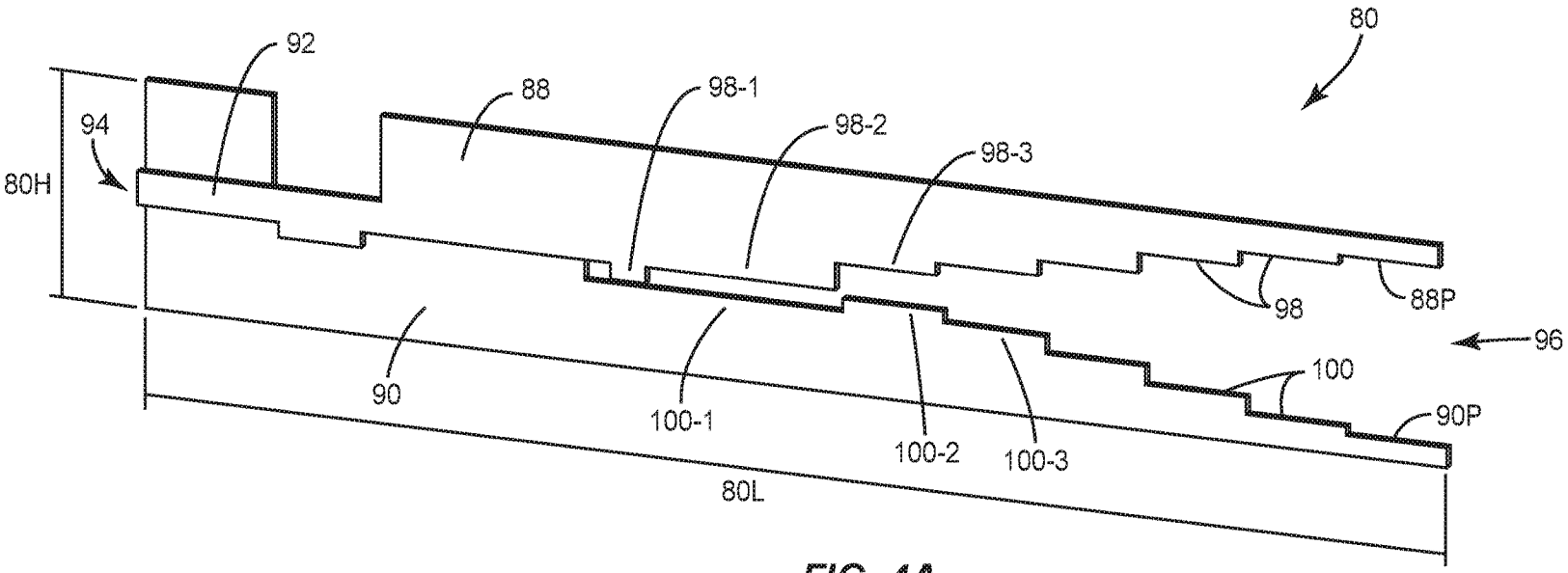
FIG. 4A is a perspective view of the representative antenna structure of FIG. 3 with the board removed.

FIG. 4A is a perspective view of the representative antenna structure 80 of FIG. 3 with the board 82 removed in order to view the ground conductor 90. The ground conductor 90 includes a second profile 90P that tapers from the first edge 94 toward the second edge 96. The first profile 88P and the second profile 90P diverge away from each other along parallel planes in a lengthwise direction along the antenna structure 80. In a similar manner to the first tuning features 98 of the signal conductor 88, the ground conductor 90 includes second tuning features 100 configured to provide a desired operating frequency and an operating bandwidth. In some embodiments, the second tuning features 100 form the second profile 90P that is stepped. In this manner, the second tuning features 100 include a series of steps 100-1 to 100-3 in the first direction from the first edge 94 to the second edge 96. The series of steps 100-1 to 100-3 include at least a first step 100-1 that is non-symmetric with a second step 100-2. As previously described, non-symmetric steps may include steps having different shapes, different heights, and different lengths. For example, the first step 100-1 may increase a height of the second profile 90P and the second step 100-2 may decrease a height of the second profile 90P. In some embodiments, the first step 100-1 may have a different height or a different length than the second step 100-2. In some embodiments, the series of steps 98-1 to 98-3 of the signal conductor 88 are non-symmetric with the series of step 100-1 to 100-3 of the ground conductor 90, providing the first stepped profile 88P that is non-symmetric with the second stepped profile 90P. For example, in some embodiments, the first step 98-1 of the signal conductor 88 is registered with at least a portion of the first step 100-1 of the ground conductor 90 along the lengthwise direction between the first edge 94 and the second edge 96. As the first stepped profile 88P and the second stepped profile 90P taper away from each other, many of the steps of the signal conductor 88 and the ground conductor 90 that are registered with one other also extend away from each. In this manner, a distance between the signal conductor 88 and the ground conductor 90 is farther apart along the lengthwise direction toward the second edge 96. However, in some embodiments, not all steps may extend away from each other. Depending on the transmission characteristics of a particular portion of the desired operating bandwidth, steps from either the signal conductor 88 or the ground conductor 90 may extend toward the other of the signal conductor 88 or the ground conductor 90. For example, the first step 98-1 of the signal conductor 88 extends toward the ground conductor 90, and the first step 100-1 of the ground conductor 90 extends away from the signal conductor 88. State differently, the first step 98-1 of the signal conductor 88 may increase a height of the first profile 88P, and the first step 100-1 of the ground conductor 90 may decrease a height of the second profile 90P. In a similar manner, the second step 100-2 of the ground conductor 90 extends toward the signal conductor 88, and the third step 98-3 of the signal conductor 88 extends away from the ground conductor 90. In some embodiments, the first step 98-1 of the signal conductor 88 comprises a different height or length than the first step 100-1 of the ground conductor 90.

The antenna structure 80 may be configured as in input antenna structure that is configured to receive an electromagnetic signal or an output antenna structure that is configured to transmit an amplified electromagnetic signal from an amplifier. In operation, when the antenna structure 80 is configured as an output antenna structure, the signal connector portion 92 is configured to receive the amplified signal. The overlapping portion between the signal connector portion 92 and the ground conductor 90 functions as a microstrip signal launch where energy propagates in a direction that is a shortest distance between the signal connector portion 92 and the ground conductor 90. At the first edge 94, the shortest distance between the signal connector portion 92 and the ground conductor 90 is directly through the board 82 (FIG. 3) from the first face 84 (FIG. 3) to the second face 86 (FIG. 3), or about perpendicular to the planes of the signal conductor 88 and the ground conductor 90. For embodiments without a board, the shortest distance is the same, except the signal connector portion 92 and the ground conductor 90 may be separated by air. As energy propagates across the antenna structure 80 toward the second edge 96, the signal conductor 88 and the ground conductor 90 taper away from each other. In this manner, the shortest distance between the signal conductor 88 and the ground conductor 90 is progressively farther apart toward the second edge 96. Accordingly, energy propagating between the signal conductor 88 and the ground conductor 90 near the second edge 96 comprises a direction that is rotated about 90 degrees from the direction near the first edge 94, or about parallel to the planes of the signal conductor 88 and the ground conductor 90. When the antenna structure 80 is configured as an input antenna structure, the operation is similar, but with a signal propagating from the second edge 96 to the first edge 94. A combination of the overall dimensions of the antenna structure 80, as well as the shape of the first profile 88P and the second profile 90P, determine the operating performance and bandwidth. In some embodiments, the antenna structure 80 comprises a height 80H of about 3-4 millimeters (mm) and a length 80L of about 22-24 mm and is configured to provide an operating bandwidth of 4 GHz to 40 GHz.

As previously described, the first tuning features 98, including the series of steps 98-1 to 98-3, form the shape of the first profile 88P. In a like manner, the second tuning features 100, including the series of steps 100-1 to 100-3, form the shape of the second profile 90P. Each individual tuning feature or step affects transmittance or reflectance in a different portion of the operating bandwidth. The tuning features 98 and 100 allow fine tuning of the antenna structure 80 during the design process. For example, the antenna structure 80 may be designed according to the dimensions above to target a desired operating bandwidth of 4 GHz to 40 GHz. The antenna structure 80 may then be tested to evaluate performance across this bandwidth. The test results may indicate improvements are needed for certain frequencies in this operating bandwidth. Accordingly, the antenna structure 80 may be re-designed where the size or shape of at least one individual tuning feature of the tuning features 98 or 100 may be adjusted. In some embodiments, the first tuning features 98 may be non-symmetric with each other across the signal conductor 88, and the second tuning features 100 may be non-symmetric with each other across the ground conductor 90.

Figure 4B:
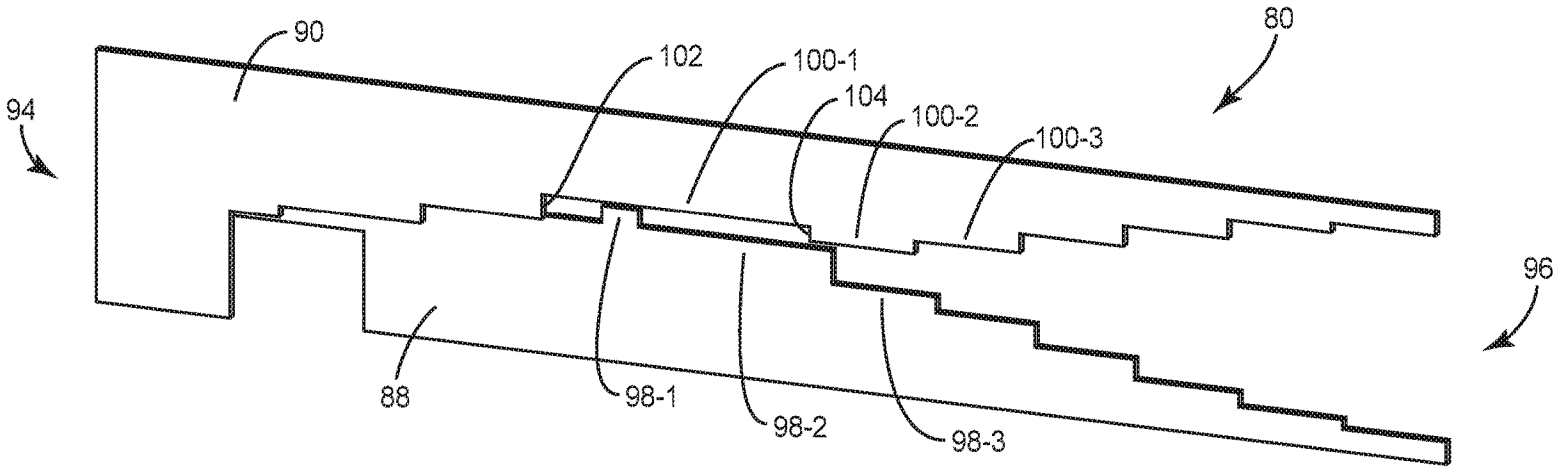
FIG. 4B is a perspective view of the representative antenna structure of FIG. 4A that is rotated from the view of FIG. 4A.

FIG. 4B is a perspective view of the representative antenna structure 80 of FIG. 4A that is rotated from the view of FIG. 4A. In FIG. 4B, the antenna structure 80 is rotated such that the ground conductor 90 and the series of steps 100-1 to 100-3 are in the foreground. Accordingly, the signal conductor 88 and the series of steps 98-1 to 98-3 are in the background. Notably, the first step 100-1 extends in a different direction than other steps, e.g. 100-2 to 100-3, and the first step 100-1 has a largest step length. In this manner, the first step 100-1 may include a first sidewall 102 and a second sidewall 104 that have different heights as the ground conductor 90 tapers from the first edge 94 toward the second edge 96.

Figure 4C:
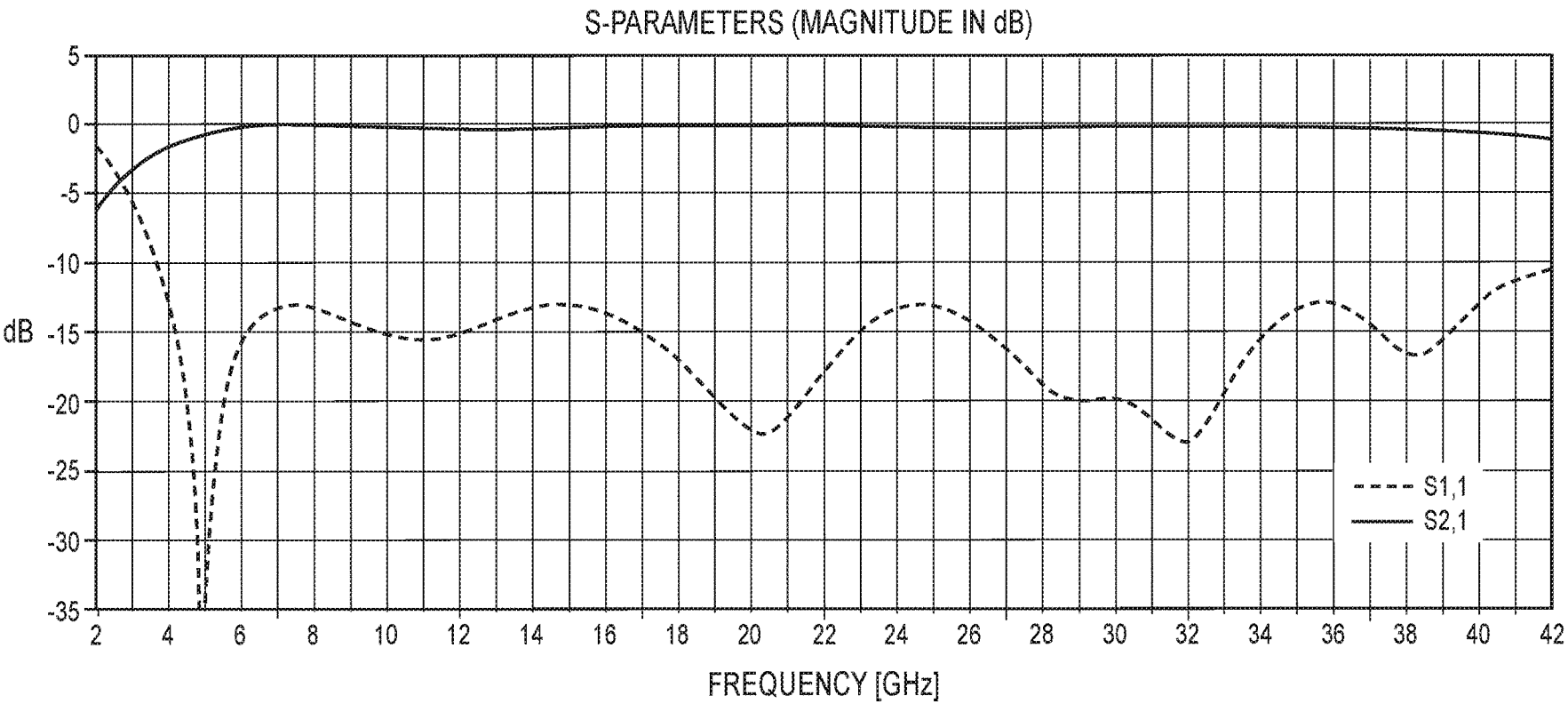
FIG. 4C is a scattering parameters (S-parameters) plot for the antenna structure illustrated in FIG. 3, FIG. 4A, and FIG. 4B.

FIG. 4C is a scattering parameters (S-parameters) plot for the antenna structure 80 illustrated in FIG. 3, FIG. 4A, and FIG. 4B. The S-parameter magnitude is plotted in decibels (dB) across a GHz frequency range. The return loss, or S1,1, is an indication of how much power is reflected from the antenna structure 80. For frequencies where S1,1 is equal to 0 dB, then substantially all power from a signal is reflected. The insertion loss, or S2,1, is an indication of how much power is transferred by the antenna structure 80. For frequencies where S2,1 is equal to 0 dB, then substantially all power from a signal is transferred. Accordingly, the antenna structure 80 demonstrates good power transfer across a wide bandwidth that includes a range of 4 GHz to 40 GHz.

Figure 5:
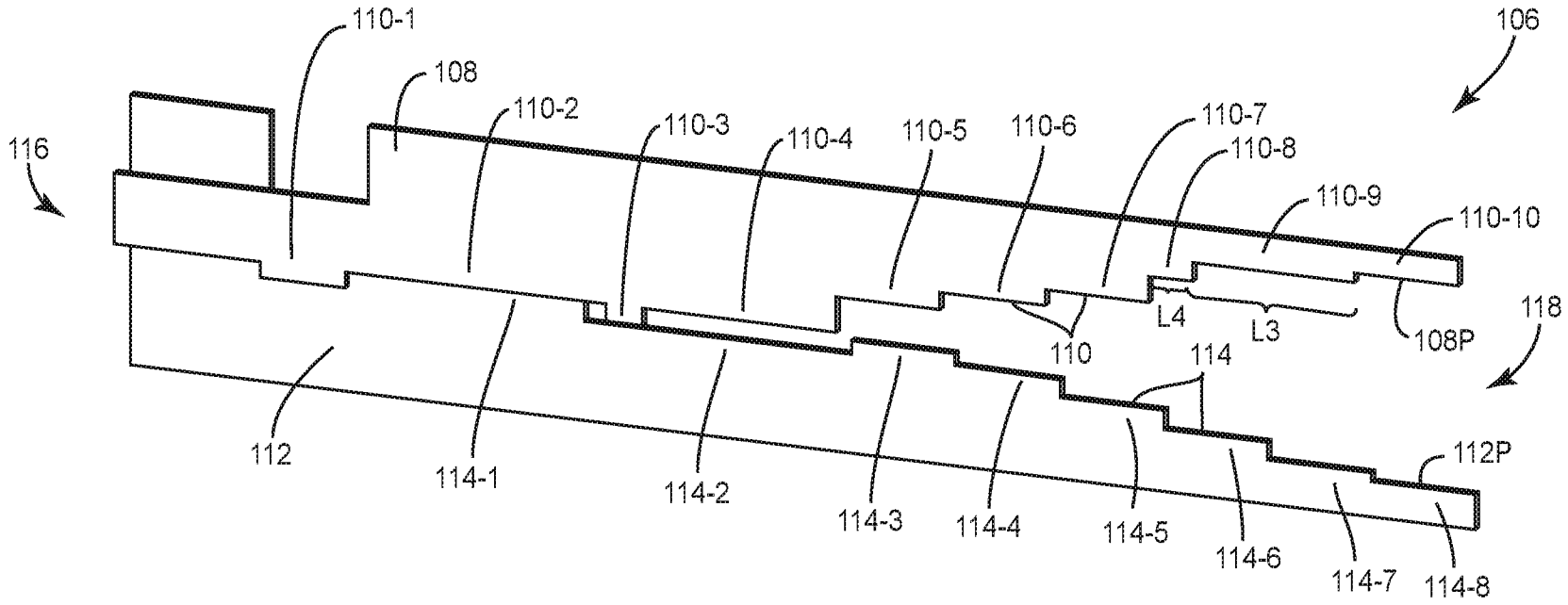
FIG. 5 is a perspective view of a representative antenna structure according to some embodiments.

FIG. 5 is a perspective view of a representative antenna structure 106 according to some embodiments. The antenna structure 106 is similar to the previously described antenna structure 80. The antenna structure 106 includes a signal conductor 108 having a first plurality of tuning features 110 that include a series of steps 110-1 to 110-10 that form a first profile 108P and a ground conductor 112 having a second plurality of tuning features 114 that include a series steps 114-1 to 114-8 that form a second profile 112P. In some embodiments, the series of steps 110-1 to 110-10 comprises a different number of tuning features as the series of steps 114-1 to 114-8. In other embodiments, the series of steps 110-1 to 110-10 and the series of steps 114-1 to 114-8 may comprise the same number of tuning features. As previously described, tuning features may comprise steps that are non-symmetric with each other across the signal conductor 108; or are non-symmetric with each other across the ground conductor 112; or are non-symmetric with each other from the signal conductor 108 to the ground conductor 112. For example, the signal conductor 108 includes the step 110-9 that comprises a length L3 that is greater than a length L4 of the step 110-8, where length is measured lengthwise across the antenna structure 106 in a direction perpendicular to a first edge 116 and a second edge 118 that opposes the first edge 116.

Figure 6:
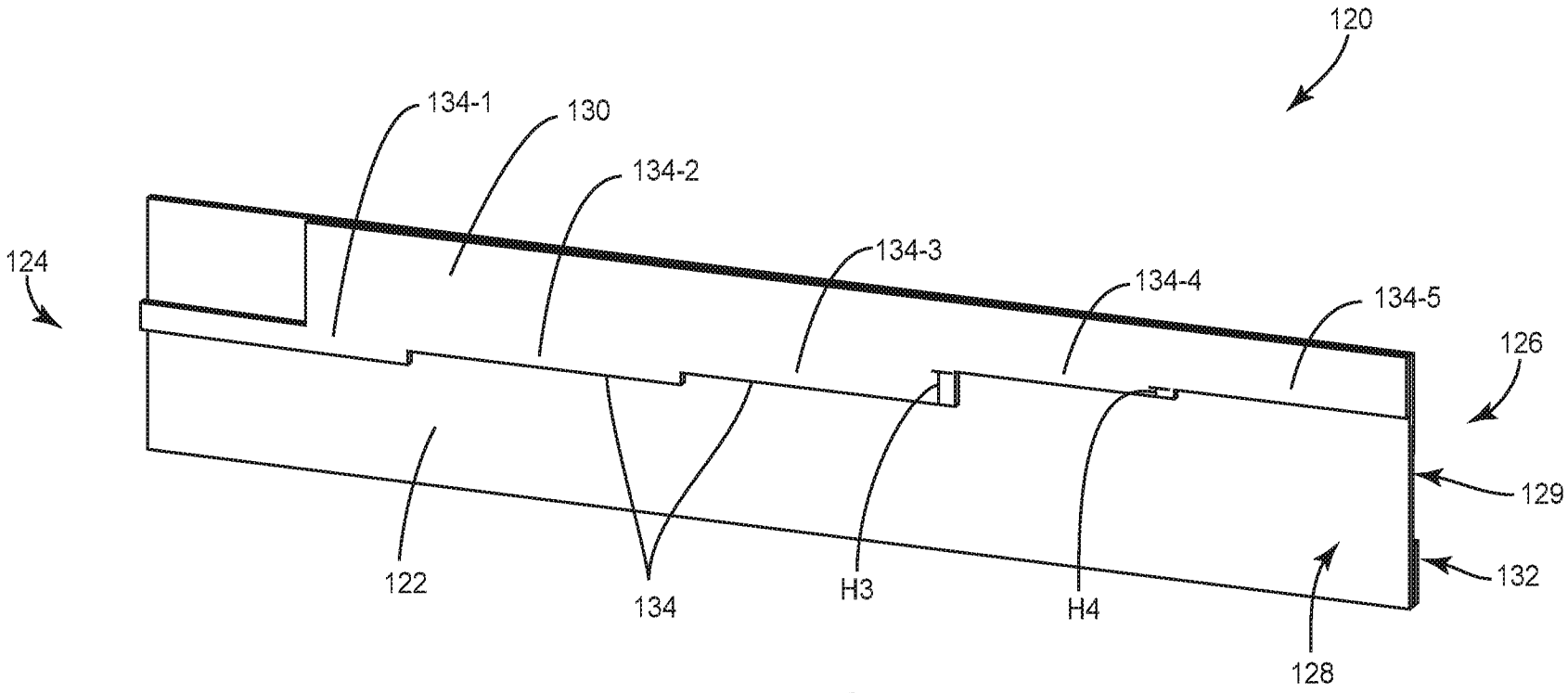
FIG. 6 is a perspective view of a representative antenna structure according to some embodiments.

FIG. 6 is a perspective view of a representative antenna structure 120 according to some embodiments. The antenna structure 120 may represent an input antenna structure or an output antenna structure as previously described. The antenna structure 120 includes a board 122, or substrate, that has a first edge 124 and an opposing second edge 126. The board also has a first face 128 and a second face 129 that opposes the first face 128. The first face 128 supports a signal conductor 130 and the second face 129 supports a ground conductor 132 that is barely visible in the perspective view. The signal conductor 130 includes a first plurality of tuning features 134 that include a series of steps 134-1 to 134-5. As previously described, at least some steps of the series of steps 134-1 to 134-5 may be non-symmetric with each other. For example, the step 134-3 comprises a height H3 that is different, in this case larger, than a height H4 for the step 134-4, where step height is the distance from the from the first step 134-3 to the second step 134-4 as measured in a direction parallel to the first edge 124 and the second edge 126.

Figure 7A:
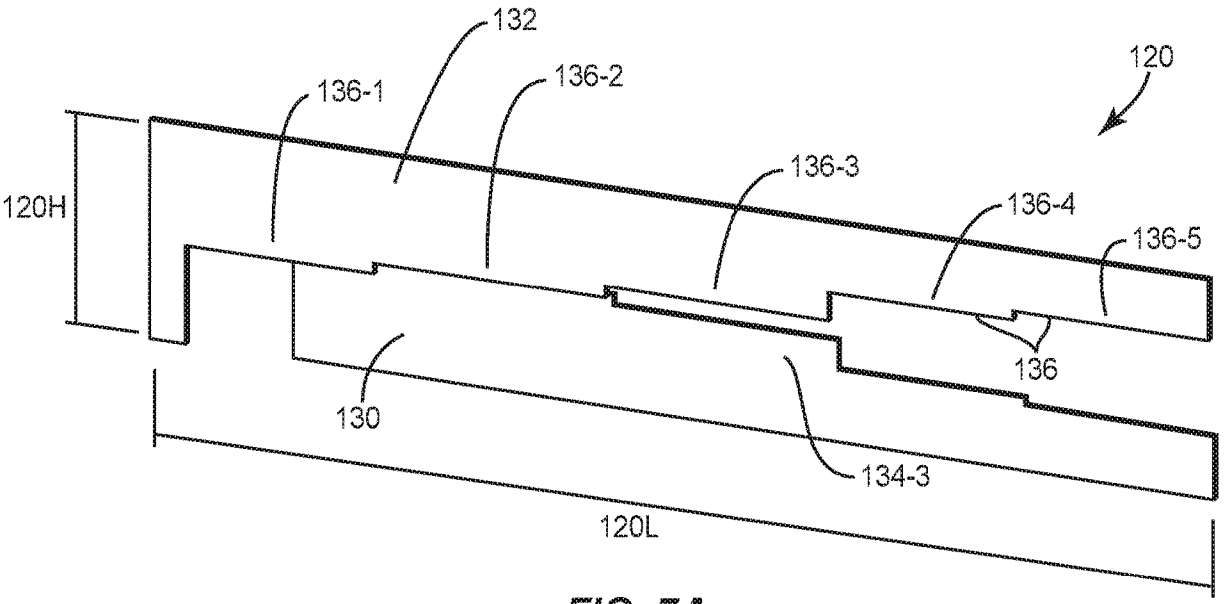
FIG. 7A is a perspective view of the representative antenna structure of FIG. 6 with the board removed and rotated such that the ground conductor is in the foreground.
Figure 7B:
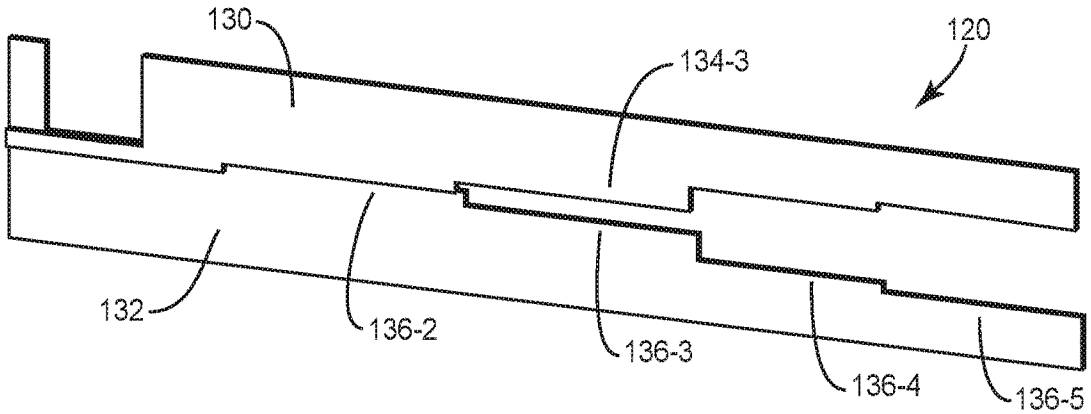
FIG. 7B is a perspective view of the representative antenna structure of FIG. 6 with the board removed and rotated such that the signal conductor is in the foreground.

FIG. 7A and FIG. 7B are alternative perspective views of the representative antenna structure 120 of FIG. 6 with the board 122 removed. FIG. 7A is a perspective view of the representative antenna structure 120 rotated such that the ground conductor 132 is in the foreground. FIG. 7B is a perspective view of the representative antenna structure 120 rotated such that the signal conductor 130 is in the foreground. The ground conductor 132 includes a second plurality of tuning features 136 that include a series of steps 136-1 to 136-5. As previously described, at least some steps of the series of steps 136-1 to 136-5 may be non-symmetric with each other. For example, the step 136-3 comprises a height that is different, in this case larger, than a height for the step 136-4. In some embodiments, a step with a largest height for the ground conductor 132, in this case the step 136-3, may be registered with a step with a largest height for the signal conductor 130, in this case the step 134-3. In some embodiments, the series of steps 136-1 to 136-5 of the ground conductor 132 may comprise a same number of steps as the series of steps 134-1 to 134-5 (FIG. 6) of the signal conductor 130.

Aspects of the present disclosure are applicable to antenna structures of various sizes. The size of an antenna structure is related to the operating bandwidth of a spatial power-combining device. In general, a device with a bandwidth including higher operating frequencies will have a smaller antenna structure than a comparable device designed to operate in a lower frequency range. In that regard, the antenna structure 120 of FIG. 7A may comprise larger dimensions configured for a lower frequency range than the antenna structure 80 of FIG. 4A. For example, the antenna structure 120 may comprise a height 120H of about 6.5-7.5 mm and a length 120L of about 41-44 mm and is configured to provide an operating bandwidth of 2 GHz to 6.5 GHz.

Figure 7C:
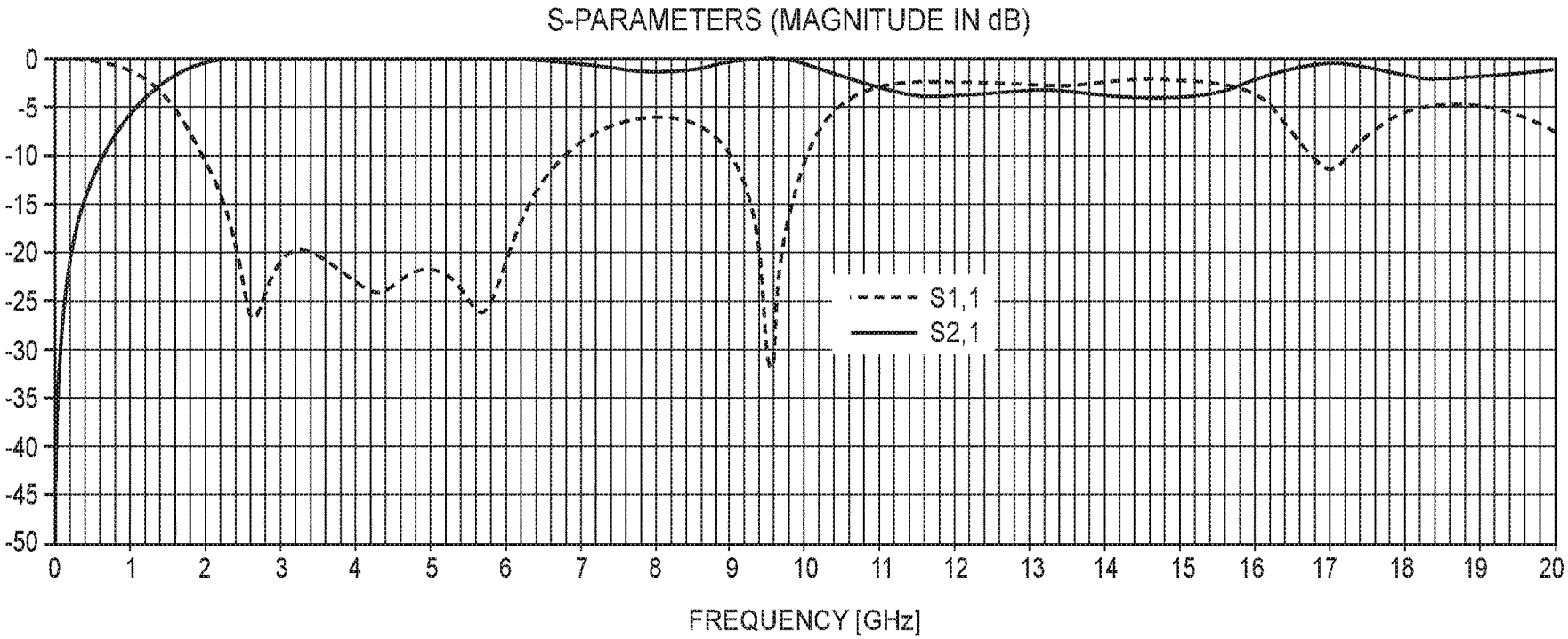
FIG. 7C is an S-parameters plot for the antenna structure illustrated in FIG. 6, FIG. 7A, and FIG. 7B.

FIG. 7C is an S-parameters plot for the antenna structure 120 illustrated in FIG. 6, FIG. 7A, and FIG. 7B. The S-parameter magnitude is plotted in dB across a GHz frequency range. The return loss, or S1,1, is an indication of how much power is reflected from the antenna structure 120. For frequencies where S1,1 is equal to 0 dB, then substantially all power from a signal is reflected. The insertion loss, or S2,1, is an indication of how much power is transferred by the antenna structure 120. For frequencies where S2,1 is equal to 0 dB, then substantially all power from a signal is transferred. Accordingly, the antenna structure 120 demonstrates good power transfer across a bandwidth that includes at least a range of 2 GHz to 6.5 GHz.

Figure 8:
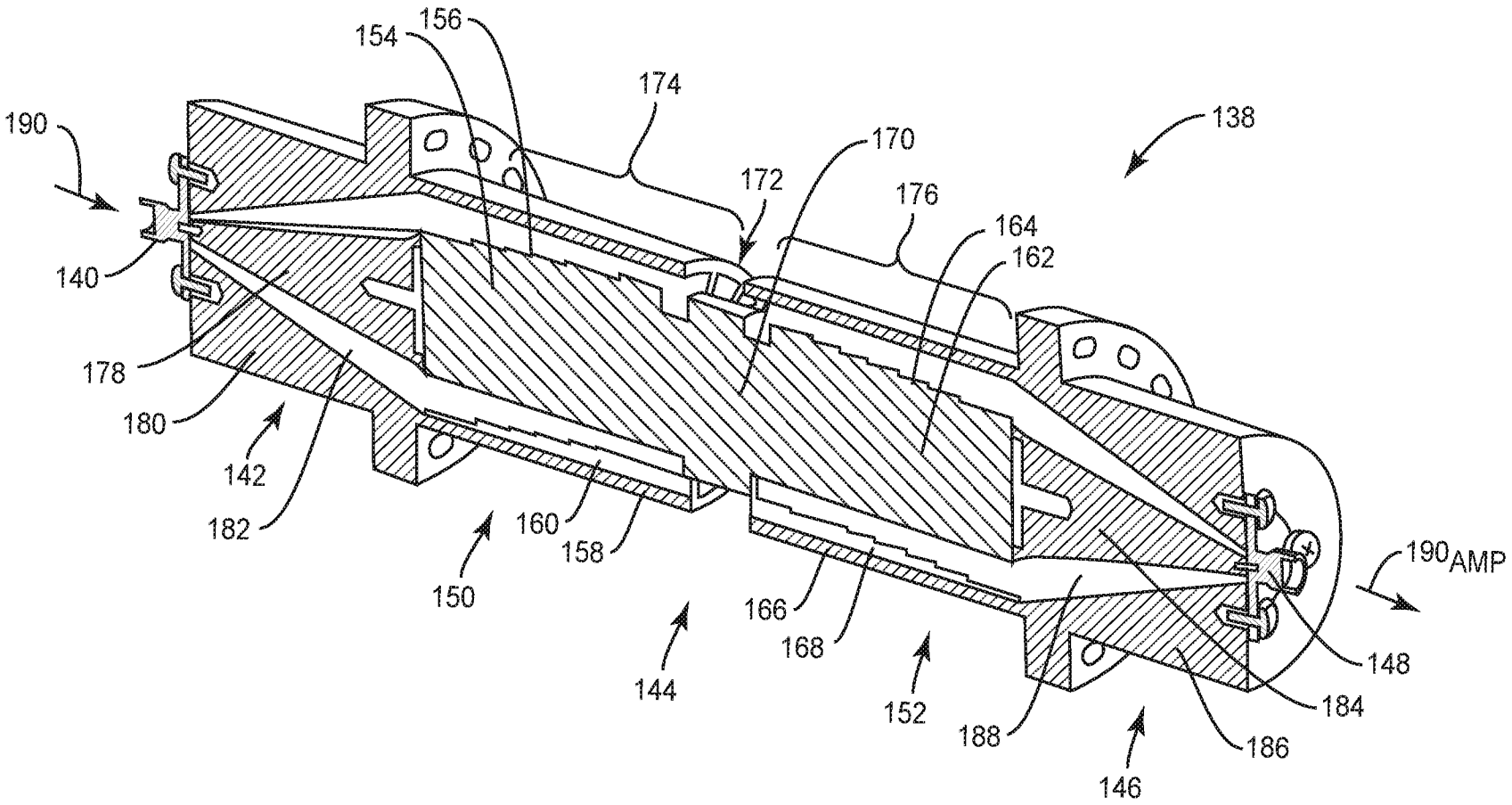
FIG. 8 is a cross-sectional view of a spatial power-combining device according to some embodiments.

Aspects disclosed herein are also applicable to spatial power-combining devices that include an antenna structure where a signal conductor and a ground conductor do not have a board, such as a printed circuit board between them. In that regard, FIG. 8 is a cross-sectional view of a spatial power-combining device 138 according to some embodiments. The spatial power-combining device 138 includes an input port 140, an input coaxial waveguide section 142, a center waveguide section 144, an output coaxial waveguide section 146, and an output port 148. The center waveguide section 144 includes an input center waveguide section 150 and an output center waveguide section 152. The input center waveguide section 150 includes an input inner housing 154 that includes a plurality of input signal conductors 156 that are radially arranged and protrude outward from the input inner housing 154. The input center waveguide section 150 also includes an input outer housing 158 that includes a plurality of input ground conductors 160 that are radially arranged and protrude inward from the input outer housing 158. In a similar manner, the output center waveguide section 152 includes an output inner housing 162 that includes a plurality of output signal conductors 164 that are radially arranged and protrude outward from the output inner housing 162. The output center waveguide section 152 also includes an output outer housing 166 that includes a plurality of output ground conductors 168 that are radially arranged and protrude inward from the output outer housing 166. Based on where the cross-section is taken, not all of the plurality of input signal conductors 156, the plurality of input ground conductors 160, the plurality of output signal conductors 164, or the plurality of output ground conductors 168 are visible. The plurality of input signal conductors 156, the plurality of input ground conductors 160, the plurality of output signal conductors 164, and the plurality of output ground conductors 168 may be arranged with tuning features such as steps as previously described.

In some embodiments, the input outer housing 158 is an integral single component with the input coaxial waveguide section 142, and the output outer housing 166 is an integral single component with the output coaxial waveguide section 146. In other embodiments, the input outer housing 158 and the output outer housing 166 are formed separately and are later attached to the input coaxial waveguide section 142 and the output coaxial waveguide section 146, respectively.

In FIG. 8, a core section 170 is configured between the input inner housing 154 and the output inner housing 162, and a plurality of amplifiers 172 are registered with the core section 170. In some embodiments, the core section 170 forms an integral single component with the input inner housing 154 and the output inner housing 162. For example, the core section 170, the input inner housing 154, and the output inner housing 162 may be formed completely from a metal, such as aluminum (Al) or alloys thereof, or copper (Cu) or alloys thereof. The metal may be machined as an integral single component that includes the core section 170 between the input inner housing 154 and the output inner housing 162. In other words, the core section 170, the input inner housing 154, and the output inner housing 162 may comprise a continuous material, such as metal. Additionally, the input outer housing 158 and the output outer housing 166 may also be formed completely of metal. In that regard, the input center waveguide section 150, the output center waveguide section 152, and the core section 170 of the spatial power-combining device 138 may all be formed completely of metal.

The plurality of input signal conductors 156 and the plurality of input ground conductors 160 form an input antenna assembly 174. The plurality of output signal conductors 164 and the plurality of output ground conductors 168 form an output antenna assembly 176. In that regard, spatial power-combining device structures may include the input antenna assembly 174 comprising the plurality of input signal conductors 156 and the plurality of input ground conductors 160, the output antenna assembly 176 comprising the plurality of output signal conductors 164 and the plurality of output ground conductors 168, and the core section 170 that is between the input antenna assembly 174 and the output antenna assembly 176. In some embodiments, the core section 170 forms an integral single component with the plurality of input signal conductors 156 and the plurality of output signal conductors 164. In some embodiments, the input antenna assembly 174, the output antenna assembly 176, and the core section 170 are formed completely of metal, such as Al or alloys thereof, or Cu or alloys thereof.

In FIG. 8, the input coaxial waveguide section 142 includes an input inner conductor 178 and an input outer conductor 180 with gradually changing profiles configured to reduce impedance mismatch from the input port 140 and the input center waveguide section 150. An opening 182 is formed between the input inner conductor 178 and the input outer conductor 180, and a portion of the opening 182 is aligned between the input inner housing 154 and the input outer housing 158. In a similar manner, the output coaxial waveguide section 146 includes an output inner conductor 184, an output outer conductor 186, and an opening 188 therebetween.

In operation, an input signal 190 is received at the input port 140. The input signal 190 then propagates through the opening 182 of the input coaxial waveguide section 142 to the input antenna assembly 174. The input signal 190 is split across the input antenna assembly 174 and is concurrently distributed in a substantially even manner to each amplifier of the plurality of amplifiers 172. The plurality of amplifiers 172 concurrently amplify respective portions of the input signal 190 to generate amplified signal portions. The plurality of amplifiers 172 transmit the amplified signal portions to the output antenna assembly 176 where they are guided to the opening 188 of the output coaxial waveguide section 146. The amplified signal portions are combined to form an amplified output signal $\mathbf{190}_{AMP}$, which is then propagated through the output port 148. In some embodiments, the input port 140, the input coaxial waveguide section 142, the input antenna assembly 174, the output antenna assembly 176, the output coaxial waveguide section 146, and the output port 148 are all formed completely of metal. In this manner, the entire structure that the electromagnetic signal passes through before and after the plurality of amplifiers 172 is metal. Accordingly, losses associated with conventional antenna structures that use printed circuit boards are eliminated. This allows spatial power-combining devices with higher frequency ranges of operation.

An all-metal configuration further provides the ability to scale the dimensions down for higher frequency ranges or scale the dimensions up for lower frequency ranges. For example, for a lower frequency range of about 350 MHz to about 1100 MHz, the spatial power-combining device 138 may comprise a length of about 50 inches from the input port 140 to the output port 148 and a diameter of the center waveguide section 144 of about 20 inches. For a medium frequency range of about 2 GHz to about 20 GHz, the spatial power-combining device 138 may be scaled to comprise a length of about 9 inches from the input port 140 to the output port 148 and a diameter of the center waveguide section 144 of about 2.3 inches. For a high frequency range of about 20 GHz to about 120 GHz, the spatial power-combining device 138 may be scaled to comprise a length of about 0.75 inches from the input port 140 to the output port 148 and a diameter of the center waveguide section 144 of about 0.325 inches. For an ultra-high frequency range of about 70 GHz to about 400 GHz, the spatial power-combining device 138 may be scaled to comprise a length of about 0.250 inches from the input port 140 to the output port 148 and a diameter of the center waveguide section 144 of about 0.1 inches. Accordingly, a spatial power-combining device may comprise the same structure, only with relative dimensions scaled up or down, and achieve any of the above frequency ranges.

An all-metal design additionally provides improved thermal capabilities that allow better power-handling for spatial power-combining devices. For example, in some embodiments, the plurality of amplifiers 172 are mounted on the core section 170 that comprises a highly thermally conductive material, such as metal. As previously described, the rest of the spatial power-combining device 138 may also comprise a highly thermally conductive material, such as metal. In operation, the core section 170 as well as other components of the spatial power-combining device 138 serve as a heat sink for heat generated by the plurality of amplifiers 172. Accordingly, the spatial power-combining device 138 has improved thermal capabilities that allow higher temperature operation with increased efficiency and higher overall output power. Representative spatial power-combining devices are described in more detail in commonly assigned U.S. patent application Ser. No. 15/981,516 filed May 16, 2018, now published as U.S. Patent Application Publication No. 2019/0067836 A1, the entirety of which is incorporated by reference herein.

Figure 9:
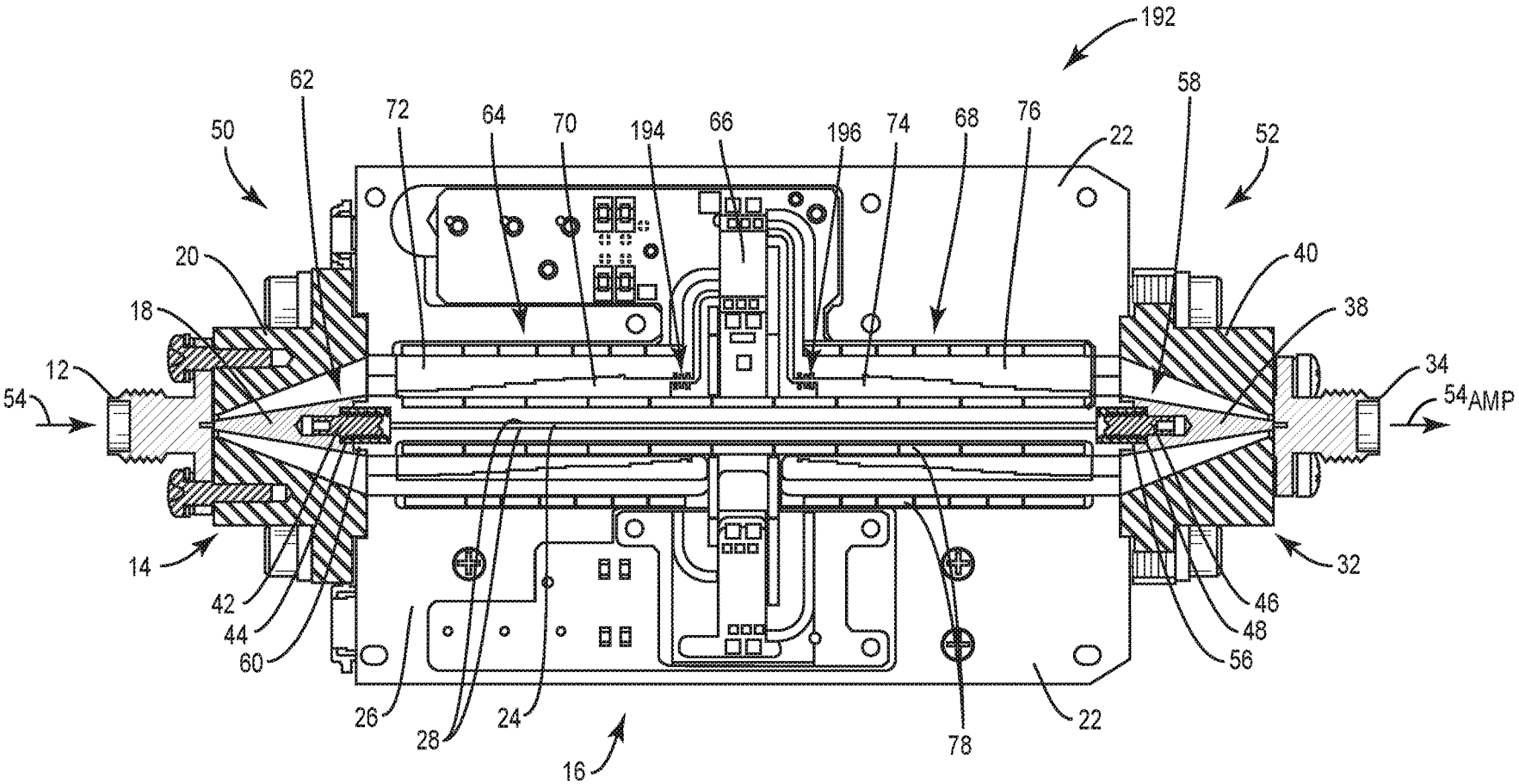
FIG. 9 is a cross-sectional view of a spatial power-combining device according to some embodiments.

Aspects disclosed herein are also applicable to spatial power-combining devices that include an antenna structure where at least one of a signal conductor and a ground conductor include a filtering element. In that regard, FIG. 9 is a cross-sectional view of a spatial power-combining device 192 according to some embodiments. The spatial power-combining device 192 is similar to the spatial power-combining device 10 of FIG. 2 and accordingly, the description of same-numbered elements 10 to 78 will not be repeated. The input signal conductor 70 may include a first filter element 194 and the output signal conductor 74 may include a second filter element 196. A filter element as described herein is incorporated to attenuate frequencies above, below, or both above and below a desired operating range. In that manner, a filter element as described herein may comprise at least one of a low-pass filter, a high-pass filter, a band-pass filter, and a band-stop filter. Any noise or other unwanted frequency components of an input signal may not be part of an amplified output signal of a spatial power-combining device. In some embodiments, the first filter element 194 may be an integral single component with the input signal conductor 70, and the second filter element 196 may be an integral single component with the output signal conductor 74. As described herein, a spatial power-combining device is configured to be self-filtering and may only amplify desired signal frequencies. Spatial power-combining devices with filtering elements are described in more detail in commonly assigned U.S. patent application Ser. No. 15/933,821 filed Mar. 23, 2018, now published as U.S. Patent Application Publication No. 2019/0067783 A1, the entirety of which is incorporated by reference herein.

Those skilled in the art will recognize improvements and modifications to the preferred embodiments of the present disclosure. All such improvements and modifications are considered within the scope of the concepts disclosed herein and the claims that follow.

What is claimed is:

1. A spatial power-combining device for modifying a signal comprising a plurality of amplifier assemblies, wherein each amplifier assembly of the plurality of amplifier assemblies comprises:

an amplifier;

an input antenna structure comprising an input signal conductor and an input ground conductor; and an output antenna structure comprising an output signal conductor and an output ground conductor, wherein at least one of the input signal conductor, the input ground conductor, the output signal conductor, and the output ground conductor comprises a stepped profile, wherein the stepped profile comprises a series of steps in a first direction and the series of steps includes at least a first step that is non-symmetric with a second step.

2. The spatial power-combining device of claim 1 wherein the first step increases a height of the stepped profile and the second step decreases a height of the stepped profile.

3. The spatial power-combining device of claim 1 wherein the first step comprises a different height than the second step.

4. The spatial power-combining device of claim 1 wherein the first step comprises a different length than the second step.

5. The spatial power-combining device of claim 1 wherein the input antenna structure further comprises:

a substrate comprising a first face and a second face that opposes the first face;

wherein the input signal conductor is on the first face and the input ground conductor is on the second face.

6. The spatial power-combining device of claim 1 wherein the input signal conductor and the input ground conductor are separated by air.

7. The spatial power-combining device of claim 1 further comprising:

an input coaxial waveguide section configured to concurrently provide a signal to the input antenna structure of each amplifier assembly of the plurality of amplifier assemblies; and an output coaxial waveguide section configured to concurrently combine a signal from the output antenna structure of each amplifier assembly of the plurality of amplifier assemblies.

8. The spatial power-combining device of claim 1 wherein at least one of the input signal conductor and the output signal conductor comprises a filter element.

9. The spatial power-combining device of claim 8 wherein the filter element comprises at least one of a low-pass filter, a high-pass filter, a band-pass filter, and a band-stop filter.

10. A spatial power-combining device for modifying a signal comprising a plurality of amplifier assemblies, wherein each amplifier assembly of the plurality of amplifier assemblies comprises:

an amplifier; and an antenna structure comprising a signal conductor with a first stepped profile and a ground conductor with a second stepped profile that is non-symmetric with the first stepped profile;

wherein the first stepped profile and the second stepped profile diverge from one another in a first direction.

11. The spatial power-combining device of claim 10 wherein the signal conductor comprises a first step and the ground conductor comprises a second step that is registered with the first step along the first direction.

12. The spatial power-combining device of claim 11 wherein the first step extends toward the ground conductor and the second step extends away from the signal conductor.

13. The spatial power-combining device of claim 11 wherein the first step extends away from the ground conductor and the second step extends away from the signal conductor.

14. The spatial power-combining device of claim 11 wherein the first step comprises a different height than the second step.

15. The spatial power-combining device of claim 11 wherein the first step comprises a different length than the second step.

16. The spatial power-combining device of claim 10 wherein the antenna structure further comprises:

a substrate comprising a first face and a second face that opposes the first face;

wherein the signal conductor is on the first face and the ground conductor is on the second face.

17. The spatial power-combining device of claim 10 wherein the signal conductor and the ground conductor are entirely separated by air.

18. The spatial power-combining device of claim 10 further comprising a coaxial waveguide section configured to concurrently provide a signal to the antenna structure of each amplifier assembly of the plurality of amplifier assemblies.

19. The spatial power-combining device of claim 10 wherein the signal conductor comprises a filter element that includes at least one of a low-pass filter, a high-pass filter, a band-pass filter, and a band-stop filter.

* * * * *